United States Patent [19]

Nakamura et al.

[11] Patent Number: 4,638,573

[45] Date of Patent: Jan. 27, 1987

[54] LINT AND RAVELING COLLECTOR FOR CLOTHES DRYER

[75] Inventors: Shin Nakamura; Keiji Hikino, both of Hitachi; Shinichi Kaji, Katsuta; Tsunetoshi Komatsu, Hitachi, all of Japan

[73] Assignee: Hitachi, Ltd., Tokyo, Japan

[21] Appl. No.: 795,771

[22] Filed: Nov. 7, 1985

[30] Foreign Application Priority Data

Nov. 9, 1984 [JP] Japan ..... 59-235126

[51] Int. Cl.[4] ..... F26B 11/04

[52] U.S. Cl. ..... 34/82; 34/85; 34/133; 55/385 R; 55/511

[58] Field of Search ..... 34/72, 79, 82, 85, 133; 55/385 R, 428, 501, 511

[56] References Cited

U.S. PATENT DOCUMENTS 3,789,514 2/1974 Faust et al. ..... 55/385 R
4,468,867 9/1984 Iwase ..... 34/82
4,557,058 12/1985 Ozawa et al. ..... 34/82

FOREIGN PATENT DOCUMENTS 53-55557 5/1978 Japan .
59-21759 6/1984 Japan .

*Primary Examiner*—Albert J. Makay
*Assistant Examiner*—David W. Westphal
*Attorney, Agent, or Firm*—Antonelli, Terry & Wands

[57] ABSTRACT

A lint and raveling collector for a clothes dryer is installed on the side of the rotating drum. The lint and raveling collector has a lint and raveling filter and a lint and raveling collecting box. The lint and raveling filter has a net-like filter member, and ribs provided on the surface of the net-like filter member to prevent friction between the filter member and the clothing. The collecting box has an opening formed at its portion facing the ribs. The collecting box covers the lint and raveling filter in such a manner that a space for accumulating the lint and raveling is defined between the lint and raveling filter and the inner wall of the whole portion of the collecting box except for the opening portion. By provision of the ribs, the lint and raveling can not pass through the interstices of the filter member, and clothing is prevented from directly rubbing against the surface of the filter member. The accumulation of the lint and raveling on the surface of the filter member does not exceed the height of the ribs, and only the portion of the heap of the lint and raveling is collected into a portion of the lint and raveling collector.

6 Claims, 13 Drawing Figures

LINT AND RAVELING COLLECTOR FOR CLOTHES DRYER

BACKGROUND OF THE INVENTION

1. Field of the Invention

The present invention relates to a lint and raveling collector for a clothes dryer which provides an improvement in the performance of the clothes dryer. More particularly, the present invention pertains to a lint and raveling collector for a clothes dryer wherein disposition of a lint, raveling and similar fine waste coming out of clothes being dried can be effected in an improved manner.

2. Description of the Prior Art

A typical conventional clothes dryer requires cleaning of an associated lint and raveling collector every time it is used to remove the lint, raveling and similar fine waste which has accumulated therein to prevent the clothes dryer from malfunctioning due to the accumulated lint, raveling and similar fine waste.

If the operator forgets to clean the lint and raveling collector and runs the clothes dryer with the lint, raveling and similar fine waste accumulated therein, the ventilation of the dryer is not adequate. This may cause the clothes dryer to overheat or moisture to condense in the air discharge duct. Such moisture may seep into the electrical wiring of the clothes dryer, causing a malfunction.

In a lint and raveling collector of a filter surface self-cleaning type of a clothes dryer, the clothing will rub directly against the filter surface of the lint and raveling collector, so that the lint, raveling and similar fine waste are forced through the interstices of the filter, thus causing the lint, raveling and similar fine waste to accumulate in the downstream side of the filter. Therefore, this conventional lint and raveling collector of the clothes dryer is not adequate for its purpose.

Apparatuses related to the above include those disclosed in, for example, the specifications of Japanese Utility Model Publication No. 21759/1984 and Japanese Patent Laid-Open Publication No. 55557/1978.

SUMMARY OF THE INVENTION

An object of the present invention is to provide a more highly efficient lint and raveling collector for a clothes dryer.

Another object of the present invention is to provide a lint and raveling collector for a clothes dryer wherein lint, raveling and similar fine waste can not pass through the interstices of the filter member.

A further object of the present invention is to provide a lint and raveling collector for a clothes dryer wherein the clothing can be prevented from directly rubbing against the surface of a filter member.

A still further object of the present invention is to provide a lint and raveling collector for a clothes dryer wherein reduction in the amount of air passing through a lint and raveling filter can be prevented from exceeding a value in relation to the resistance due to a predetermined amount of accumlation of the lint, raveling and similar fine waste.

Still another object of the present invention is to provide a lint and raveling collector for a clothes dryer in which it is unnecessary to effect cleaning every time the clothes dryer is used.

A still further object of the present invention is to provide a lint and raveling collector for a clothes dryer wherein portions of a clothes dryer on the downstream side of a lint and raveling collector can be prevented from being clogged with lint, raveling and similar fine waste.

The present invention provides a lint and raveling collector for a clothes dryer in which clothing is housed and dried by heated air supplied to a rotating drum, the lint and raveling collector being installed on the side of the rotating drum where the heated air is discharged so as to collect the lint, raveling and similar fine waste coming off the clothing, characterized in that the lint and raveling collector comprises: a lint and raveling filter having a net-like filter member to collect the lint, raveling and similar fine waste, and a plurality of ribs provided on the surface of the net-like filter member to prevent friction between the net-like filter member and the clothing; and a lint and raveling collecting box having an opening portion formed at a portion facing the ribs of the lint and raveling filter, the lint and raveling collecting box covering the lint and raveling filter in such a manner that a space for accumulating the lint, raveling and similar fine waste is defined between the lint and raveling filter and the inner wall of the whole portion of the lint and raveling collecting box except for the opening portion.

The arrangement of the present invention will be described below in more detail.

With the present invention, each of the ribs which has an appropriate height is provided on the surface of a net-like filter member, so that the lint, raveling and similar fine waste can not pass through the interstices of the net-like filter member, which occurs in the conventional self-cleaning lint and raveling collector. Accordingly, the clothing is prevented from directly rubbing against the surface of the net-like filter member.

Further, the accumulation of the lint, raveling and similar fine waste on the surface of the net-like filter member does not exceed the height of the ribs, and only the portion of the heap of the lint, raveling and similar fine waste which have accumulated in excess of the height of the ribs is collected into a portion of the lint and raveling collector which has a fixed volume, the collecting being caused by the movement of the clothing, whereby the reduction in the amount of air passing through the lint and raveling filter is prevented from exceeding a value in relation to the resistance due to a predetermined amount of accumulation of the lint, raveling and similar fine waste.

With the present invention, it is possible to simplify the lint and raveling collection of the clothes dryer and therefore provide a highly efficient lint and raveling collector for the clothes dryer. Thus, the present invention is greatly advantageous in practical use.

DETAILED DESCRIPTION OF THE PREFERRED EMBODIMENT

One embodiment of a lint and raveling collector for a clothes dryer according to the present invention will be described below with reference to the accompanying drawings.

Figure 1:
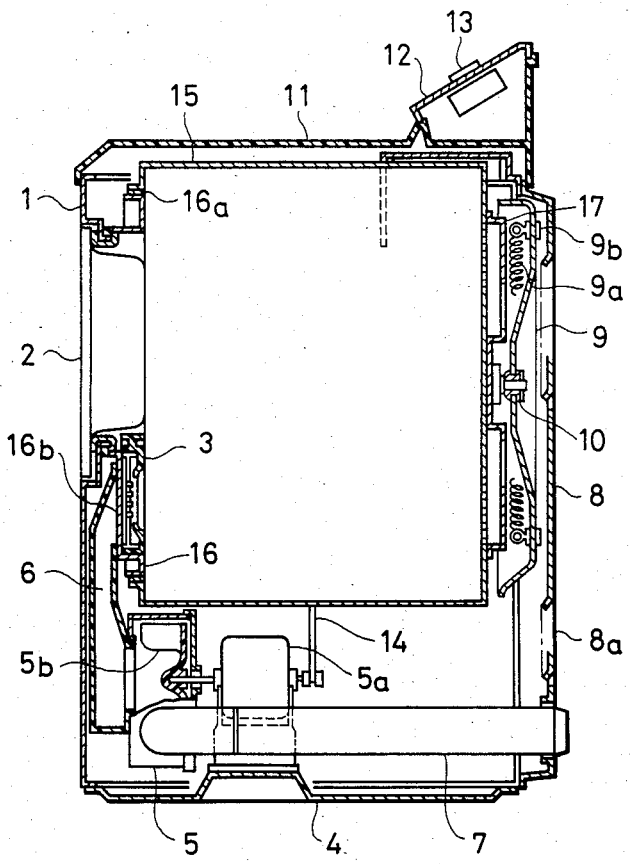
FIG. 1 is a vertical sectional view of a clothes dryer equipped with a lint and raveling collector in accordance with one embodiment of the present invention.

FIG. 1 is a vertical sectional view of a clothes dryer equipped with a lint and raveling collector in accordance with one embodiment of the present invention.

The lint and raveling collector in accordance with this embodiment is arranged so as to be detachably secured to a drum support of the clothes dryer.

Referring first to FIG. 1, a casing is constituted by an outer frame 1, an outer frame base 4, and a rear cover 8 with an air inlet 8*a*. A rotating drum 15 is housed in the casing in such a manner as to be rotatably supported by a drum support 16 and a drum holder 10.

The drum support 16 has a slider 16*a* secured to the outer frame 1, and the drum holder 10 is mounted on a heater case 9 which houses a heater 9*a* through heater supporting plates 9*b*. The rotating drum 15 has a heat-insulating plate 17 provided between the rotating drum 15 and the heater 9*a*.

The reference numeral 2 denotes a door which is mounted on the outer frame 1 in such a manner that the door 2 can be opened and closed when clothing is taken in and out of the rotating drum 15. The reference numeral 11 represents a top cover on which is mounted a panel section 12 provided with a control unit 13.

A blower 5 has a motor 5*a* and a fan 5*b* and is connected to the drum support 16 through a duct 6. In operation, the blower 5 sucks in outside air from the air inlet 8*a* of the rear cover 8. This air is heated by the heater 9*a* and introduced into the rotating drum 15 so as to dry clothing contained therein and then is discharged to the outside of the machine body through an air outlet 16*b* and the duct 6 and through a discharge pipe 7.

In FIG. 1, the reference numeral 3 denotes a lint and raveling collector in accordance with one embodiment of the present invention. The lint and raveling collector 3 is arranged such as to be directly in the path of the air flowing through the rotating drum 15 so as to collect the lint, raveling and similar fine waste coming out of the clothing and contained in the air. The reference numeral 14 represents a belt.

Figure 2:
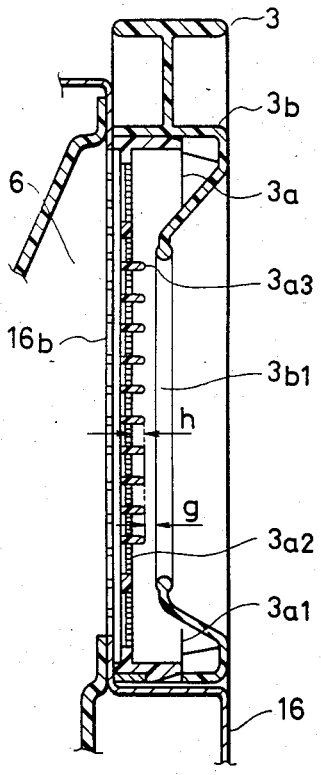
FIG. 2 is an enlarged sectional view of a surrounding part of the lint and raveling collector shown in FIG. 1.
Figure 3:
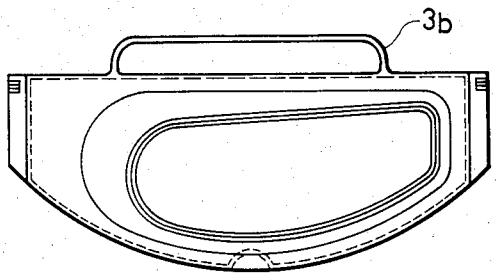
FIGS. 3 to 5 are plan views showing the arrangement of an essential portion of the lint and raveling collector of the present invention.
Figure 4:
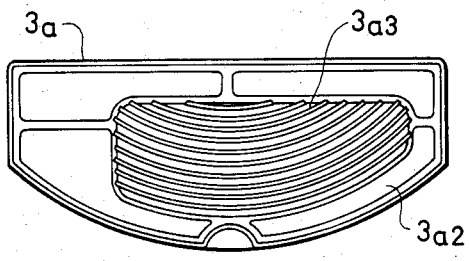
Figure 5:
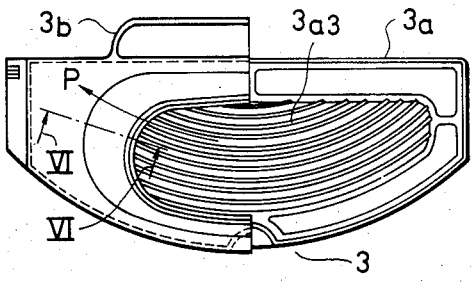

FIG. 2 is an enlarged sectional view of a surrounding part of the lint and raveling collector 3, and FIGS. 3 to 5 are plan views showing the arrangement of an essential portion of the lint and raveling collector 3 of the present invention.

Referring next to FIGS. 2 to 5, the lint and raveling collector 3 is constituted by a lint and raveling filter 3*a* and a lint and raveling collecting box 3*b* which are superposed one upon the other.

The lint and raveling filter 3*a* of the lint and raveling collector 3 is constituted by a frame member 3*a*1 and a net-like filter member 3*a*2 which are formed by, for example, integral molding. The net-like filter member 3*a*2 is provided on its surface with a plurality of ribs 3*a*3 with an appropriate height h from the surface of the net-like filter member 3*a*2.

The lint and raveling collecting box 3*b* of the lint and raveling collector 3 has its substantially central portion opened with a predetermined opening area. The periphery of an opening portion 3*b*1 of the lint and raveling collecting box 3*b* covers the lint and raveling filter 3*a* in such a manner as to define a space therebetween which has an appropriate volume.

An appropriate gap g is provided between the edge of the opening portion 3*b*1 and the respective distal ends of the ribs 3*a*3 of the lint and raveling filter 3*a*.

The appropriate height h in this case is a minimum height at which clothing is prevented from rubbing against the surface of the net-like filter member 3*a*2 of the lint and raveling filter 3*a*. This height h changes depending upon the pitch of the ribs 3*a*3.

The predetermined opening area of the lint and raveling collecting box 3*b* in this case is an opening area at which the ventilation of the clothes dryer is not obstructed. In addition, the appropriate volume of the space defined by the outer peripheral portion of the lint and raveling collecting box 3*b* and the lint and raveling filter 3*a*, for example, is such that the amount of the lint, raveling and similar fine waste collected by the lint and raveling collector 3 is maximized for the particular volume. The appropriate gap g will be described later.

Figure 6:
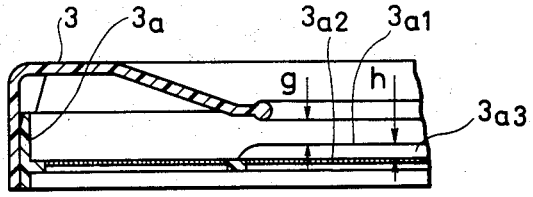
FIG. 6 is a sectional view taken along the line VI—VI of FIG. 5.

FIG. 6 is a sectional view of the lint and raveling collector 3 taken along the line VI—VI of FIG. 5, which shows the above-described appropriate height h and the appropriate gap g.

The ribs 3*a*3 of the lint and raveling filter 3*a* are aligned substantially parallel to the direction of rotation P of the rotating drum 15 so that the ribs 3*a*3 do not obstruct the movement of the clothing in response to the rotation of the rotating drum 15.

The operation of the embodiment arranged as above will now be described with reference to FIGS. 7 to 11C.

Figure 11A:
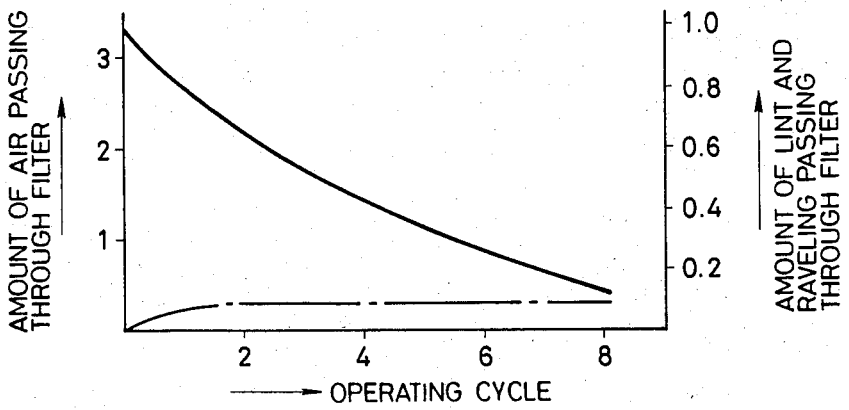
FIG. 11A is a graph showing the performance of a conventional lint and raveling collector.
Figure 11B:
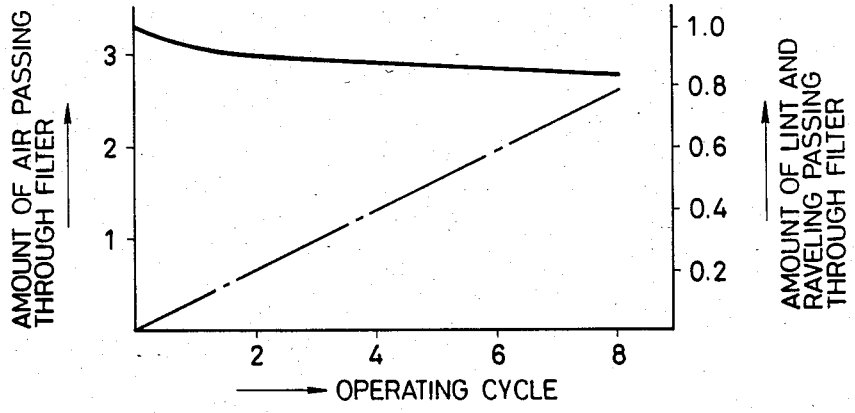
FIG. 11B is a graph showing the performance of a conventional self-cleaning type lint and raveling collector.
Figure 11C:
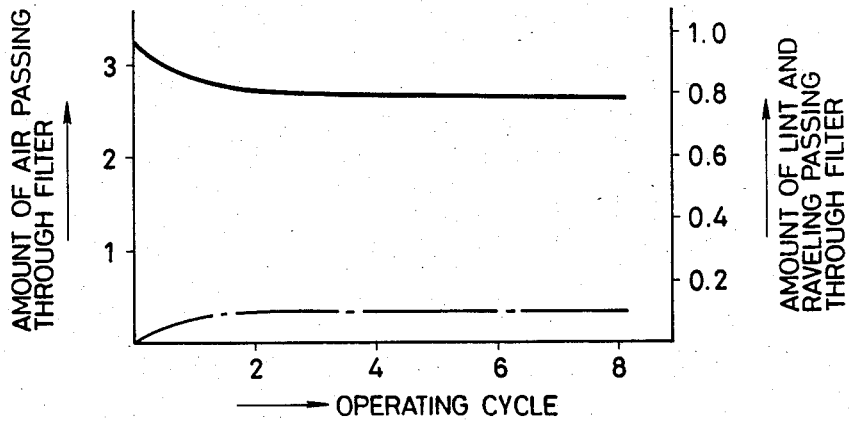
FIG. 11C is a graph shown in the performance of the lint and raveling collector according to the present invention.

FIGS. 7 to 10 in combination show the operation of the lint and raveling collector 3 in accordance with one embodiment of the present invention, and FIG. 11A, FIG. 11B and FIG. 11C show the comparison as to the performance between the present invention and the prior art.

When the clothes dryer is operated, clothing A is tumble-dried by the rotation of the rotating drum 15, and the clothes rub against each other, causing the lint, raveling and similar fine waste B to be produced. The clothing A also includes a large amount of lint and raveling B adhering thereto during washing.

Figure 7:
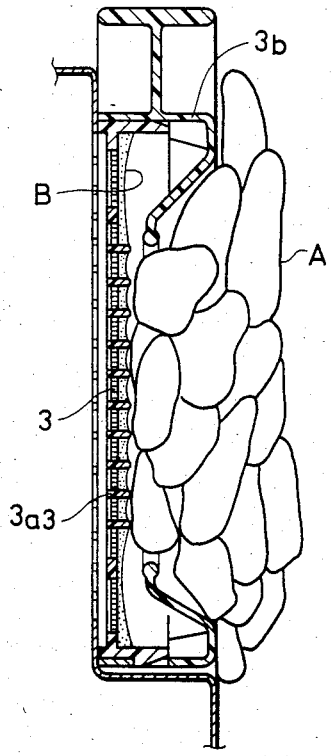
FIGS. 7 to 10 in combination show the operation of the lint and raveling collector in accordance with one embodiment of the present invention.
Figure 8:
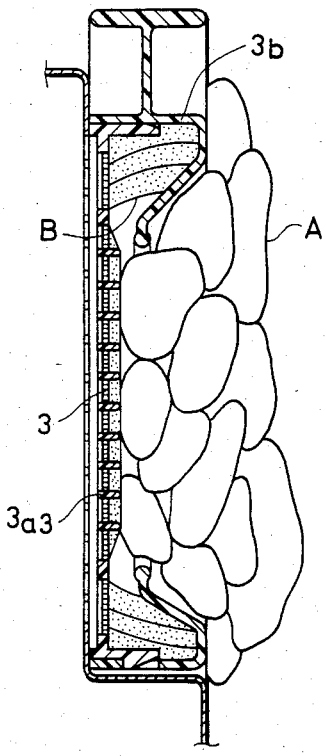
Figure 9:
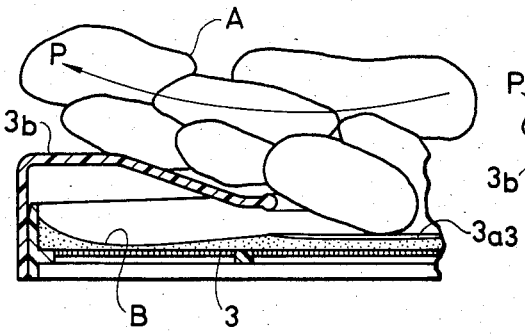
Figure 10:
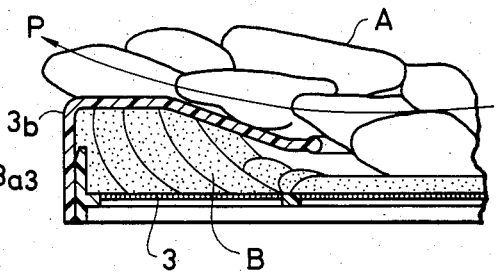

Such lint, raveling and similar fine waste B disengage from the clothing A during drying, and are blown away by the blower 5 and finally collected by the lint and raveling filter 3*a* of the lint and raveling collector 3 (see FIGS. 7 and 9).

As the operation proceeds, the height of the heap of the accumulated lint, raveling and similar fine waste B exceeds the height h of the ribs 3*a*3 of the lint and raveling filter 3*a*. The portion of the heap of the lint, raveling and similar fine waste B which exceeds the height h is moved by the movement P of the clothings A which move while projecting out from the opening portion 3*b*1 of the lint and raveling collecting box 3*b* toward the lint and raveling filter 3*a* (the movement P of the clothing A coincides with the direction of rotation of the rotating drum 15; see FIGS. 5, 9 and 10), and accumulates in the outer peripheral portion of the lint and raveling collecting box 3*b* (see FIGS. 8 and 10).

Thus, it is possible to collect an amount of the lint, raveling and similar fine waste B corresponding to the volume of the space defined by the outer peripheral portion of the lint and raveling collecting box 3*b* and the lint and raveling filter 3*a*.

If the volume of the above-described space is set such as to correspond to the amount of the lint, raveling and similar fine waste B collected when the clothes dryer has been used, for example, ten or twenty times, it cleans the lint and raveling collector 3 at this interval, so that it is unnecessary to effect cleaning every time the clothes dryer is used, as is now conventionally required.

In addition, since the lint, raveling and similar fine waste B accumulate on the surface of the net-like filter member 3*a*2 of the lint and raveling filter 3*a* only as high as the height h of the ribs 3*a*3 of the lint and raveling filter 3*a*, if the height h of the ribs 3*a*3 is set at an appropriate value, the increase in the resistance against ventilation caused by the accumulated lint, raveling and similar fine waste B can be suppressed below a predetermined value.

If the operator should forget to clean the lint and raveling collector 3, it may become impossible for the lint, raveling and similar fine waste B to be further accommodated in the space defined by the outer peripheral portion of the lint and raveling filter 3*a* and the lint and raveling collecting box 3*b*, and in such a case, the lint, raveling and similar fine waste B may undesirably be moved toward the rotating drum 15.

In the present invention, however, the increase in the ventilation resistance is suppressed below a predetermined value as described above, so that it is possible to prevent the occurrence of problems arising from an abnormal temperature rise in various portions of the clothes dryer, and condensation of moisture in the duct.

The leakage of the lint, raveling and similar fine waste B toward the rotating drum 15 causes the lint, raveling and similar fine waste B to adhere to the clothing A, and this makes the user aware, when the drying operation is finished, that the lint and raveling collector 3 needs cleaning.

Further, in the present invention, the surface of the net-like filter member 3*a*2 of the lint and raveling filter 3*a* is not directly rubbed by clothing A as in the case of the conventional self-cleaning type lint and raveling collector. Therefore, it is possible to prevent the portions of the clothes dryer on the downstream side of the lint and raveling collector 3 from being clogged with lint, raveling and similar fine waste B extruded from the interstices of the net-like filter member 3*a*2 of the lint and raveling filter 3*a* and forced therethrough.

As described above, the present invention makes it possible to readily and reliably solve one of the serious problems conventionally experienced with clothes dryers, that is, handling of the lint, raveling and similar fine waste B.

FIGS. 11A, 11B and 11C show the comparison as to the operation performance between the present invention and the prior art under the same conditions with respect to the amount of clothing A, the running time, the area of the net-like filter member 3*a*2 of the lint and raveling filter 3*a* and so forth.

FIG. 11A is a graph showing the performance of a conventional lint and raveling collector; FIG. 11B is a graph showing the performance of a conventional self-cleaning type lint and raveling collector; and FIG. 11C is a graph showing the performance of the lint and raveling collector 3 according to the present invention.

Each of these graphs shows the change in the amount of the air passing through the lint and traveling filter (solid line) and the change in the amount of the lint, raveling and similar fine waste passing through the lint and traveling filter (the onedot chain line) by the lint and raveling collecting operation effected by each apparatus, with the operating cycle represented by the axis of the abscissa.

It is a matter of course that the gap g between the edge of the central opening of the lint and raveling collecting box 3*b* and the respective distal ends of the ribs 3*a*3 of the lint and raveling filter 3*a* must be appropriately set so that the lint, raveling and similar fine waste B moved by the movement of the clothing A can easily pass through the gap g, yet relatively small items of clothing A, such as a handkerchief and socks are prevented from entering the lint and raveling collecting box 3*b* through the gap g.

In the lint and raveling collector 3 in accordance with the above-described embodiment, the ribs 3*a*3 extend in alignment with the direction of rotation of the rotating drum 15 to allow the clothing A to move smoothly and facilitate the collection of the lint, raveling and similar fine waste B. However, even if the ribs 3*a*3 of the lint and raveling filter 3*a* are not disposed parallel to the direction of rotation of the rotating drum 15, there will not necessarily create problems in practice.

Although the lint and raveling collector in accordance with the above-described embodiment is arranged such as to be detachably secured to the drum support, the lint and raveling collector may be mounted on the rotating drum so as to rotate with the rotating drum. In such a case, the disposition relationship between the blower and the heater should be appropriately changed.

We claim:

1. A lint and raveling collector for a clothes dryer in which clothing is housed and dried by heated air supplied to a rotating drum, a lint and raveling collector being installed in the side of the clothes dryer where the heated air is discharged from said rotating drum so as to collect the lint, raveling and similar fine waste coming out of the clothing, said lint and raveling collector comprising:

a lint and raveling filter having a net-like filter member for collecting lint, raveling and similar fine waste, and means including a plurality of ribs provided on the surface of said filter member for preventing the occurrence of any friction from direct contact between said net-like filter member and the clothing; and a lint and raveling collecting box having an opening portion formed at a portion facing said ribs of said lint and raveling filter, said lint and raveling collecting box covering said lint and raveling filter in such a manner that a space for accumulation of the lint, raveling and similar fine waste is defined between said lint and raveling filter and an inner wall of the whole portion of said lint and raveling collecting box, except for the opening portion thereof.

2. A lint and raveling collector for a clothes dryer according to claim 1, wherein said plurality of ribs of said lint and raveling filter are formed so as to extend substantially parallel to the direction of movement of the clothes adjacent thereto as effected by rotation of said rotating drum.

3. A lint and raveling collector for a clothes dryer according to claim 2, wherein said ribs of said lint and raveling filter are disposed in the opening portion of said lint and raveling collecting box.

4. A lint and raveling collector for a clothes dryer according to claim 1, wherein a gap is provided between an edge of the opening portion of said lint and raveling collecting box and respective distal ends of each of said ribs of said lint and raveling filter.

5. A lint and raveling collector for a clothes dryer according to claim 1, in which said drum is supported by a drum support, and wherein said lint and raveling collector is arranged to be detachably secured to a drum support.

6. A lint and raveling collector for a clothes dryer according to claim 1, wherein said lint and raveling collector is mounted on said rotating drum so as to rotate with said rotating drum.

* * * * *